United States Patent [19]

Sugioka

[11] Patent Number: 4,771,961

[45] Date of Patent: Sep. 20, 1988

[54] YARN TRAVERSE APPARATUS

[75] Inventor: Takami Sugioka, Matsuyama, Japan

[73] Assignee: Teijin Seiki Company Limited, Osaka, Japan

[21] Appl. No.: 56,690

[22] Filed: Jun. 2, 1987

[30] Foreign Application Priority Data

Jun. 3, 1986 [JP] Japan ..... 61-129566

[51] Int. Cl.[4] ..... B65H 54/38

[52] U.S. Cl. ..... 242/18.1

[58] Field of Search ..... 242/18.1, 18 R, 18 DD, 242/43 R, 26, 45, 36

[56] References Cited

U.S. PATENT DOCUMENTS

| | | | |
|---|---|---|---|
| 4,135,673 | 1/1979 | Gallus et al. | 242/18.1 |
| 4,394,986 | 7/1983 | Hasegawa et al. | 242/18.1 X |
| 4,487,374 | 12/1984 | Sugioka et al. | 242/18.1 X |
| 4,494,702 | 1/1985 | Miyake et al. | 242/18.1 X |
| 4,504,021 | 3/1985 | Schippers et al. | 242/18.1 |
| 4,504,024 | 3/1985 | Gerhartz | 242/18.1 |
| 4,515,320 | 5/1985 | Slavik et al. | 242/18.1 X |
| 4,667,889 | 5/1987 | Gerhartz | 242/18.1 |
| 4,676,441 | 6/1987 | Maag | 242/18.1 |

FOREIGN PATENT DOCUMENTS

| | | | |
|---|---|---|---|
| 41060 | 12/1970 | Japan | 242/18.1 |
| 39134 | 11/1971 | Japan | 242/18.1 |
| 57-33264 | 7/1982 | Japan . | |

*Primary Examiner*—Stanley N. Gilreath

*Attorney, Agent, or Firm*—Cushman, Darby & Cushman

[57] ABSTRACT

A yarn traverse apparatus for winding a yarn on a bobbin, comprising setting means for setting a limit value of a crossing angle, a traverse stroke, a width of the yarn, and a ribbon occurrence region; means for detecting the number of rotations of the bobbin; means for detecting a winding speed of the yarn; means for calculating a diameter of the package in accordance with the number of rotations of the bobbin and the winding speed of the yarn; means for calculating a winding ratio in accordance with the number of turns of the yarn over two traverse strokes and with the number of turns of the yarn over one pitch corresponding to the limit value of the crossing angle, and varying the winding ratio in steps so that the winding ratio is moved outside the ribbon occurrence region when the package reaches a predetermined value within a predetermined region of the crossing angle; means for calculating the number of traverse strokes in accordance with the number of rotations of the bobbin and the winding ratio corresponding to the package diameter; and a traverse mechanism for traversing the yarn in accordance with an output of the traverse operation means.

3 Claims, 9 Drawing Sheets

YARN TRAVERSE APPARATUS

FIELD OF THE INVENTION

The present invention relates in general to a yarn traverse apparatus for winding a continuous yarn or thread on the bobbin, and in particular to an improved yarn traverse apparatus which can prevent an occurrence of a so-called ribbonning during the yarn winding operation.

SUMMARY OF THE INVENTION

In accordance with an important aspect of the present invention, there is provided a yarn traverse apparatus a bobbin on which a yarn is wound forming a yarn package; means for rotating the bobbin comprising setting means for setting upper and lower limit values of a crossing angle of the yarn, a traverse stroke of said yarn package wound on the bobbin, a width of the yarn wound on the bobbin, and a ribbon occurrence region; bobbin rotational number detecting means for detecting the number of rotations of the bobbin on which the package is wound; winding-speed detecting means for detecting a winding speed of the yarn; package-diameter operation means for calculating a diameter of the package in accordance with the number of rotations of the bobbin detected by the bobbin rotational number detecting means and the winding speed of the yarn detected by said winding-speed detecting means; winding-ratio operation means for calculating a winding ratio in accordance with the number of turns of the yarn when a distance of two traverse strokes is divided by the yarn width and the number of turns of the yarn when one pitch corresponding to the upper limit value of the crossing angle is divided by the yarn width; traverse operation means for calculating the number of traverse strokes in accordance with the number of rotations of the bobbin and the winding ratio corresponding to the package diameter; and a traverse mechanism for traversing the yarn alternately in opposite directions parallel to an axis of rotation of the bobbin in accordance with an output of the traverse operation means so that the yarn is wound throughout the traverse stroke of the package, the winding-ratio operation means varying the winding ratio in steps so that the winding ratio is moved outside the ribbon occurrence region when the package diameter reaches a predetermined value between the upper and lower limit values of the crossing angle.

DESCRIPTION OF THE PRIOR ART

In winding a continuous yarn or thread at high speed on a bobbin and forming a yarn package on the bobbin, the yarn is generally wound with a constant crossing angle of the yarn during the yarn winding operation. In this case, when a ratio of the number of rotations of the bobbin to the number of yarn traversing strokes (hereinafter referred to as a "winding ratio") is an integral number, the yarn to be wound tends to be wound on a turn of the yarn previously wound on the bobbin, thereby making the outer circumferential surface of the yarn package uneven and forming circumferential rib portions on the yarn package (called "ribbonning"). Such a ribbonning phenomenon may cause the outer circumferential layer of the yarn package to slide toward the center or a vibration during the yarn winding operation. If the vibration is caused by the ribbonning phenomenon, the yarn tends to be unwound from the layer of the circumferential rib portion formed previous to the rib portion being now formed.

In order to avoid these disadvantages, a step type yarn traverse device has been proposed in Japanese patent publication No. 57-33264. In this device, the aforementioned winding ratio is varied in steps to prevent the occurrence of ribbonning during the yarn winding operation. The conventional yarn traverse device of the step type, however, still has the following disadvantages:

(I) It is recently desired that a various kinds of brands of different deniers be produced with a short cycle. In this instance, the winding ratio is required to be varied depending upon different widths of different yarns. It is, however, difficult to vary the winding ratio depending upon the different widths.

(II) In the case that, in one yarn take-up device, it is required to vary a yarn traversing stroke depending upon a various kinds of yarns in response to the requirement of FMS (Flexible Manufacturing System which is a manufacturing system having functions capable of accommodating to multikind and small quantity production), it is difficult to vary the yarn traversing stroke. For example, it is the case that, in one yarn take-up device, a winding of four cops (i.e., four yarn packages and a stroke of 170) and a winding of eight cops (i.e., a stroke of 70) are put into practice.

(III) Since an actual diameter of the package actually wound on the bobbin differs from a package diameter calculated from the number of rotations of the bobbin due to the contact pressure applied between the package and the friction roller held in rolling engagement with the package and due to the rib portions at the axial opposite ends of the package, there are the fluctuations of winding ratio. Furthermore, since the number of yarn traversing strokes is calculated by detecting the number of rotations of the bobbin and multiplying the detected value by the winding ratio, there is a delay of time in the calculation. Because of the delay of time, even if a winding ratio is set which does not cause the occurrence of ribbonning, the ribbonning will occur if the winding ratio is set in the vicinity of an integral number.

The aforementioned disadvantages all degrade quality of the yarn wound on the bobbin.

It is, accordingly, an important object of the present invention to provide an improved yarn traverse apparatus which is capable of enhancing quality of the yarn wound on the bobbin and which eliminates the aforementioned disadvantages attendant with the prior art. The object of the present invention is achieved by varying the winding ratio in steps so that an occurrence of ribbonning and the like is avoided.

BRIEF DESCRIPTION OF THE DRAWINGS

The features and advantages of a yarn traverse apparatus according to the present invention will be more clearly understood from the following description in which.

DESCRIPTION OF THE PREFERRED EMBODIMENTS

Figure 1:
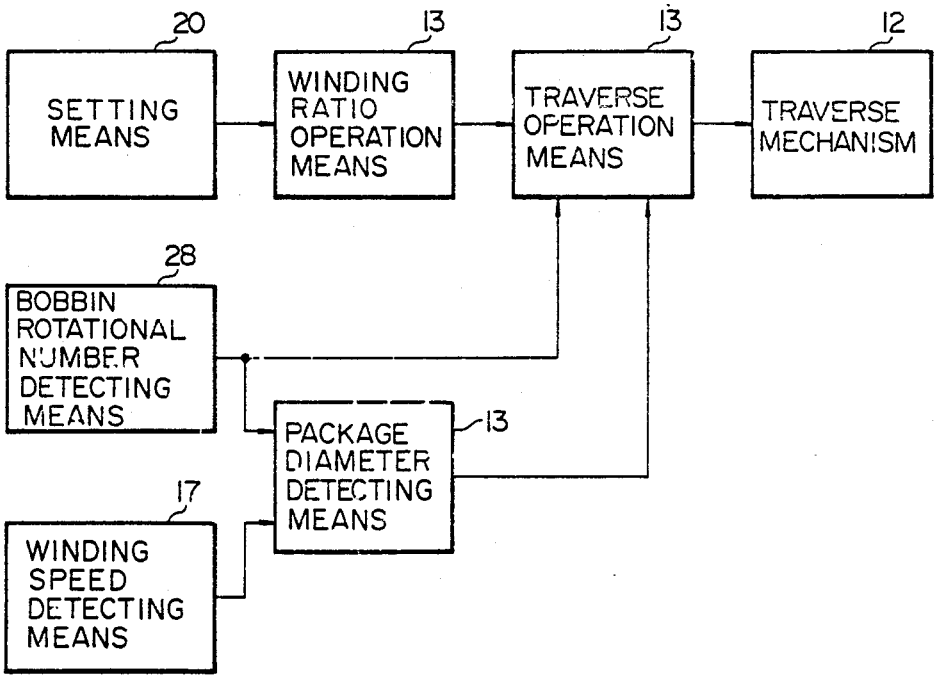
FIG. 1 is a block diagram showing the fundamental concept of the present invention.
Figure 2:
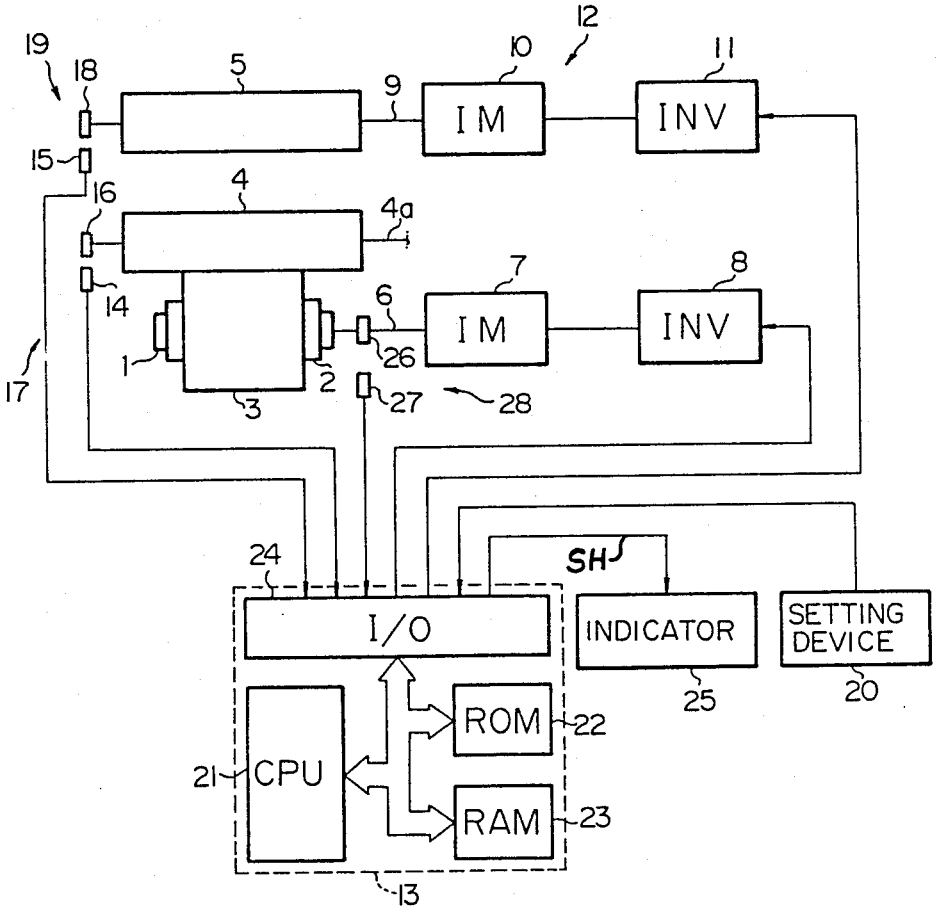
FIG. 2 is a diagrammatic view of one embodiment of the yarn traverse apparatus according to the present invention.

Referring now to FIG. 2 of the drawings, a cylindrical bobbin, designated by reference numeral 2, is rotatably supported on a bobbin spindle 1. The bobbin 2 is adapted to have a continuous yarn or thread wound thereon into a suitable form of yarn package 3. In parallel with the bobbin 2 is provided a friction roller 4 which is carried on a roller shaft 4*a* and which is rotatable on the shaft 4*a*. During the yarn winding operation, the yarn package 3 on the bobbin 2 is held in rolling contact with the friction roller 4. The yarn to be wound on the bobbin 2 is fed through a yarn traversing cam 5 adapted to move the yarn alternately in opposite directions parallel with the center axis of the bobbin 2 so that the yarn is distributed uniformally throughout the length of the yarn package 3.

The spindle 1 of the bobbin 2 is connected through a drive shaft 6 to an induction motor 7 so that the bobbin 2 is driven for rotation about the spindle 1. The induction motor 7 is connected with an invertor 8 and rotates with the frequency corresponding to the output of the invertor 8. Thus, the bobbin 2 rotates with the frequency corresponding to the output of the invertor 8. The yarn traversing cam 5 is connected through a drive shaft 9 to an induction motor 10 so that it is driven for rotation about the drive shaft 9. The induction motor 10 is connected with an invertor 11 and rotates with the frequency corresponding to the output of the invertor 11. Thus, the yarn traversing cam 5 rotates with the frequency corresponding to the output of the invertor 11. The aforementioned yarn traversing cam 5, drive shaft 9, induction motor 10 and invertor 11 as a whole constitute a traverse mechanism indicated generally by reference numeral 12.

The output of each of the invertors 8 and 11 is controlled by command signals from a controller 13 to which signals from first and second electromagnetic pick-ups 14 and 15 are inputted. The first electromagnetic pick-up 14 is disposed adjacent a gear 16 fixed on the shaft 4*a* of the friction roller 4 and detects the number of rotations of the gear 16. As a result, the number of rotations Nc of the friction roller 4 is detected indirectly from the number of rotations of the gear 16. The first electromagnetic pick-up 14 and the gear 16 of the friction roller 4 as a whole constitute winding-speed detecting means for detecting a winding speed of the yarn, which is designated generally by reference numeral 17. The second electromagnetic pick-up 15 is disposed adjacent a gear 18 fixed on the drive shaft 9 of the yarn traversing cam 5 and detects the number of rotations of the gear 18. As a result, the number of rotations Nt of the yarn traversing cam 5 is detected indirectly from the number of rotations of the gear 18. The second electromagnetic pick-up 15 and the gear 18 of the yarn traversing cam 5 as a whole constitute cam rotational number detecting means for detecting the number of rotations of the yarn traversing cam 5, which is designated generally by reference numeral 19. A third electromagnetic pick-up 27 is disposed adjacent a gear 26 fixed on the drive shaft 6 of the bobbin 2 and detects the number of rotations Nb of the bobbin 2. The third electromagnetic pick-up 27 and the gear 26 of the drive shaft 6 as a whole constitute bobbin rotational number detecting means for detecting the number of rotations of the bobbin 2, which is designated generally by reference numeral 28.

To the controller 13 is inputted a signal from a setting device or means 20 which is adapted to set an upper limit value $\theta_H$ of a crossing angle (FIG. 4) of the yarn, a traverse stroke S of the package to be wound, a width w of the yarn to be wound, and a ribbon occurrence region Y. These values may be set manually by an operator of a winding machine or automatically by the setting device 20 itself on the basis of information from the controller 13.

The controller 13 has a package-diameter operation means, a winding-ratio operation means and a traverse operation means, and comprises a central processing unit 21 labelled as "CPU", a read-only memory 22 labelled as "ROM", a random access memory 23 labelled as "RAM" and an input-output port 24 labelled as "I/O". The CPU 21 has received therein external datum which are necessary in accordance with programs read on the ROM 22, and processes values necessary for the yarn traversing control, giving and receiving datum between the CPU 21 and the RAM 23. The processed values are transferred from the CPU 21 to the I/O port 24. The I/O 24 receives signals from the electromagnetic pick-ups 14, 15 and 27 and a signal from the setting device 20 and delivers command signals to the invertors 8 and 11 and an indicative signal $S_H$ to an indicator 25. The ROM 22 has stored therein programs and datum in the CPU 21. The RAM 23 temporarily memorizes external information and datum to be used in operation. The indicator 25 indicates information necessary for the winding control on the basis of the indicative signal $S_H$ delivered from the controller 13.

Figure 3:
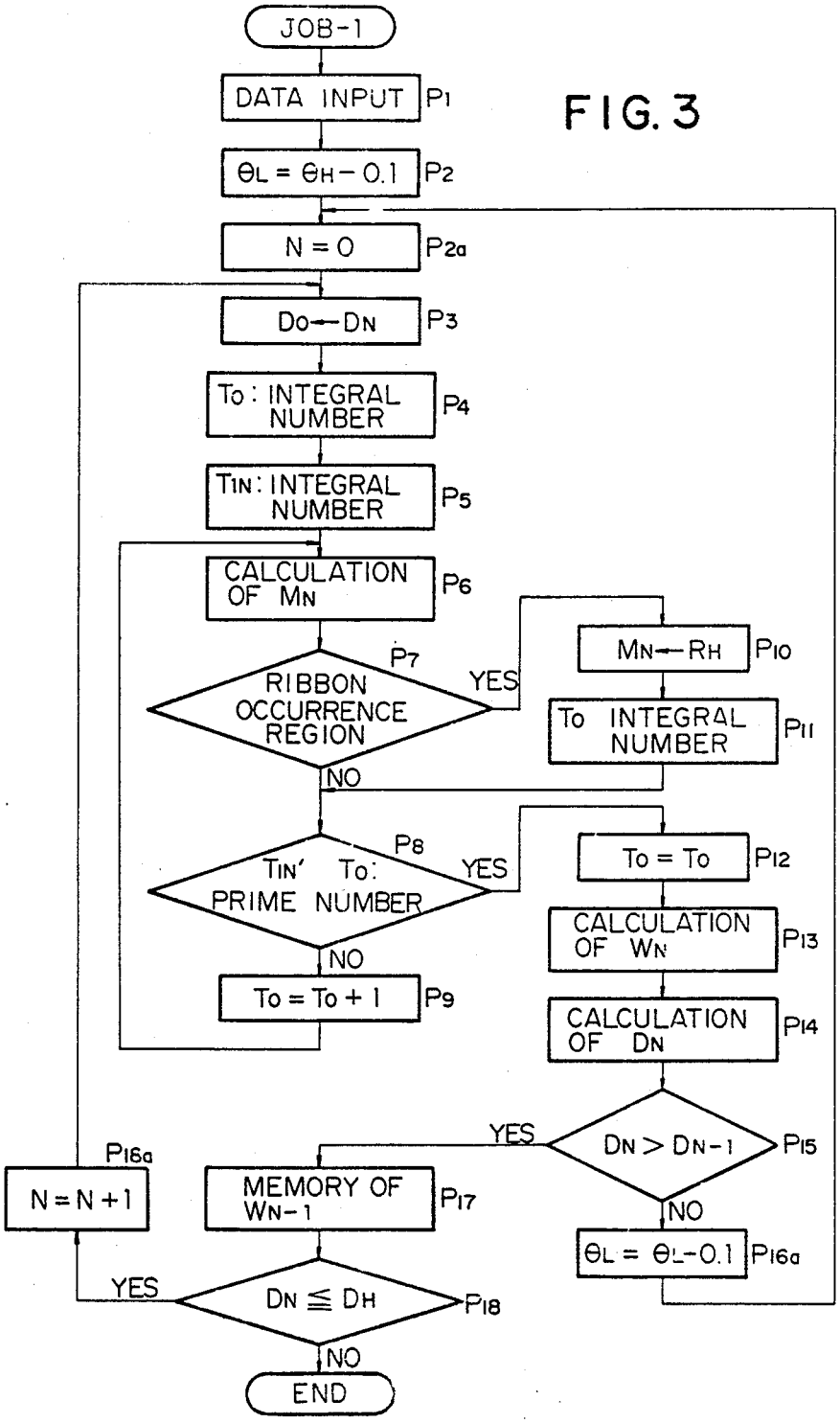
FIG. 3 is a block diagram of a program for calculating the winding ratio of the embodiment shown in FIG. 2.
Figure 5:
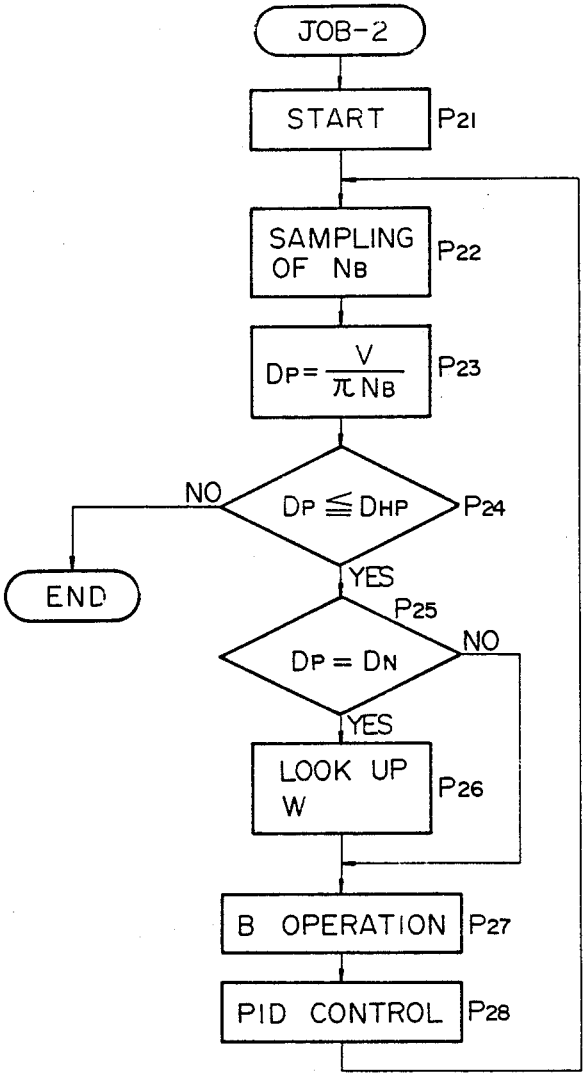
FIG. 5 is a block diagram of a program for calculating the number of the yarn traverse strokes of the embodiment shown in FIG. 2.

FIGS. 3 and 5 are respectively block diagrams showing a program for the yarn traversing control. The yarn traversing control program according to the present invention consists of a winding-ratio arithmetic operation program indicated by "JOB-1" in FIG. 3 and a traverse number arithmetic operation program indicated by "JOB-2" in FIG. 5. The winding-ratio program JOB-1 and the traverse number program JOB-2 are processed in the recited order.

In FIG. 3, the winding-ratio program JOB-1 commences by an input commencement operation to the setting device 20. At a step $P_1$ in the program JOB-1, necessary information, that is, a yarn winding speed $V_1$, a yarn traverse stroke S, a yarn width w, an upper limit value $\theta_H$ of the crossing angle, and a ribbon occurrence region Y (FIG. 6) are first set. At a step $P_2$, a lower limit value $\theta_L$ of the crossing angle is calculated in accordance with the following equation (1):

$$\theta_L=\theta_H-0.1 \quad (1).$$

Figure 4:
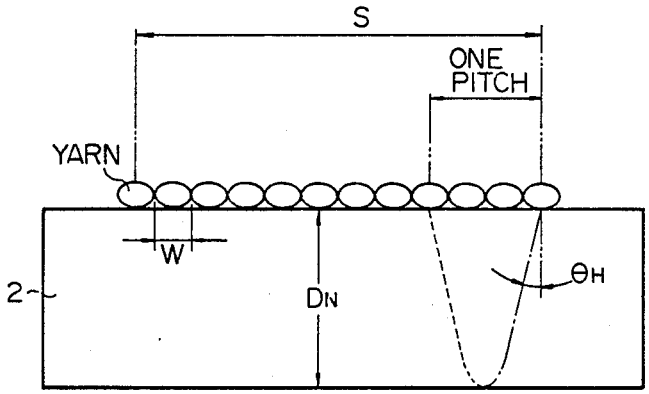
FIG. 4 is a schematic view of a bobbin on which a yarn is wound through a yarn traverse stroke with an upper limit value of a crossing angle.

After a count value of the number of changes of the winding ratio (hereinafter referred to as a "change count value") is set up as N=0 at a step $P_{2a}$, a diameter $D_N$ of the yarn package 3 is set up as $D_0$ at a step $P_3$. That is, the package diameter $D_0$ is a diameter of the unwound bobbin 2 when the change count value N is zero. The yarn traverse stroke S, yarn width w, upper limit value $\theta_H$ of the crossing angle, and package diameter $D_N$ are shown in FIG. 4. At a step $P_4$, the number of turns $T_0$ of the yarn wound on the bobbin 2 over one layer (that is, the number of turns $T_0$ of the yarn when a distance of two traverse strokes 2S is divided by the width w of the yarn) is calculated in accordance with the following equation (2), and changed into an integral number by omitting fractions or raising to a unit or counting fractions of 0.5 and over as an integral number.

$$T_0=2\,S\,/\,w \quad (2).$$

Likewise, at a step $P_5$, the number of turns $T_{1(N)}$ of the yarn over one pitch corresponding to the upper limit value $\theta_H$ of the crossing angle (that is, the number of turns $N_{1N}$ of the yarn when the one pitch is divided by the yarn width w of the yarn) is calculated in accordance with the following equation (3) and changed into an integral number by omitting fractions or raising to a unit or counting fractions of 0.5 and over as an integral number.

$$T_{1(N)}=\pi D_N \tan\theta_H\,/\,w \quad (3).$$

In the equations (2) and (3), it is preferable that the yarn width w be one to 1.2 times the actual size of the yarn.

Thereafter, at a step $P_6$, a temporary winding ratio $M_N$ is calculated in accordance with the following equation (4):

$$M_N=T_0\,/\,T_{1(N)} \quad (4).$$

The temporary winding ratio $M_N$ means the state wherein the yarn of width w is wound through one layer with that the number of rotations $N_B$ of the bobbin 2 is $T_0$ and the number of traverses is two times $T_{1(N)}$. At a step $P_7$, the temporary winding ratio $M_N$ is compared with the ribbon occurrence region Y. It is noted that a so-called ribonning (the yarn to be wound is wound on a turn of the yarn previously wound on the bobbin and makes the outer circumferential surface of the yarn package uneven) occurs if the winding ratio is within the ribbon occurrence region Y. If the temporary winding ratio $M_N$ is not within the ribbon occurrence region Y, the $T_{1(N)}$ and the $T_0$ are discriminated at a step $P_8$ whether they are prime numbers from each other or not. If the $T_{1(N)}$ and the $T_0$ are not prime numbers from each other, a value of 1 is added to the $T_0$ or $T_{1(N)}$ at a step $P_9$ and thereafter, the $T_0$ or $T_{1(N)}$ are returned back to the step $P_6$. In this instance, for example, in the case of the $T_0$, the value of 1 is added to the $T_0$ as $T_0=T_0+1$. It is noted that the addition may be also processed in accordance with the following equation (5):

$$T_0=T_0-1$$

$$T_{1(N)}=T_{1(N)}+1$$

$$T_{1(N)}=T_{1(N)}-1 \quad (5).$$

If, on the other hand, the temporary winding ratio $M_N$ calculated at the step $P_6$ is within the ribbon occurrence region Y at the step $P_7$, it is replaced with an upper limit value $R_H$ of the ribbon occurrence region Y ($M_N=R_H$) at a step $P_{10}$ so that the temporary winding ratio $M_N$ is not within the ribbon occurrence region Y. A new $T_0$ is calculated at a step $P_{10}$ by the aforementioned equation (4) wherein the temporary winding ratio $M_N$ is equal to the upper limit value $R_H$ of ribbon occurrence region Y. The new $T_0$ calculated at the step $P_{10}$ is changed into an integral number at a step $P_{11}$. Thereafter, the $T_0$ advances from the step $P_{11}$ to the step $P_8$. It is noted that, in the stead of the $T_0$, the $T_{1(N)}$ may be also calculated at the step $P_{10}$ by the aforementioned equation (4) wherein the temporary winding ratio $M_N$ is equal to the upper limit value $R_H$ of ribbon occurrence region Y and changed into an integral number at the step $P_{11}$. Thus, the step $P_6$ through the step $P_9$ and the steps $P_{10}$ and $P_{11}$ are repeated so that the $T_0$ and the $T_{1(N)}$ become prime numbers from each other and that the temporary winding ration $M_N$ is moved outside the ribbon occurrence region Y.

When the $T_0$ and the $T_{1(N)}$ become prime numbers from each other and the temporary winding ration $M_N$ is not within the ribbon occurrence region Y, the $T_0$ and the $T_{1(N)}$ advance from the step $P_8$ to a step $P_{12}$. At the step $P_{12}$, the $T_0$ thus processed through the steps noted above is set up as a new $T_0$, and at a step $P_{13}$, a true winding ratio $W_N$ is calculated in accordance with the following equation (6):

$$W_N=T_0/T_{1(N)} \quad (6).$$

It is noted that if, in the stead of the $T_0$, the $T_{1(N)}$ is calculated at the step $P_{10}$ by the aforementioned equation (4), the $T_{1(N)}$ may be also set up as a new $T_{1(N)}$.

Thereafter, the package diameter $D_N$ is calculated at a step $P_{14}$ when the lower limit value of the crossing angle and the winding ratio are $\theta_L$ and $W_N$, respectively. The package diameter $D_N$ calculated at the step $P_{14}$ is compared at a step $P_{15}$ with the package diameter $D_{N-1}$ calculated through the previous routine. If the package diameter $D_N$ is equal to or less than the package diameter $D_{N-1}$, a new lower limit value $\theta_L$ of the crossing angle is set up by the following equation (7):

$$\theta_L=\theta_L-0.1 \quad (7).$$

The new lower limit value $\theta_L$ of the crossing angle returns back to the step $P_{2a}$. As a result, the difference between the upper and lower limit values $\theta_H$ and $\theta_L$ of the crossing angle gradually increases by 0.1 degrees. If, on the other hand, the package diameter $D_N$ is more than the package diameter $D_{N-1}$, it advances from the step $P_{15}$ to a step $P_{17}$. At the step $P_{17}$, the winding ratio $W_{N-1}$ corresponding to the package diameter $D_{N-1}$ is memorized in the random access memory (RAM) 23 of the aforementioned controller 13. At a step $P_{18}$, the package diameter $D_N$ is compared with the maximum diameter $D_H$ of a machine specification value. If the package diameter $D_N$ is equal to and less than the diameter $D_H$, the change count value N is increased at a step $P_{18a}$ as N=N+1. The change count value N increased by one returns back to the step $P_3$. Thereafter, the aforementioned steps are repeated. If, on the other hand, the package diameter $D_N$ is more than the $D_H$, that is, if the diameter of the yarn package 3 exceeds the specification value of the machine, the calculation of the winding ratio W is completed, so that the winding-ratio operation program JOB-1 ends. The traverse number operation program JOB-2 shown in FIG. 5 is then processed.

The traverse number operation program JOB-2 commences at a step $P_{21}$ thereof by an actuation switch of the yarn take-up device. When the operation of the yarn take-up device commences, the number of rotations $N_B$ of the bobbin 2 is sampled in consecutive order with predetermined cycles at a step 22. At a step 23, a varying diameter $D_P$ of the package 3 is calculated with the number of rotations $N_B$ sampled at the step 22 and the yarn winding speed V in accordance with the following equation (8):

$$D_P = V/(\pi N_B) \quad (8).$$

The diameter $D_P$ of the package 3 calculated at the step 23 is compared with the maximum diameter $D_{HP}$ of a machine specification value at a step 24. If the diameter $D_P$ of the package 3 is more than the maximum diameter $D_{HP}$, it is determined that it is impossible to wind, and therefore the now processing routine ends. If, on the other hand, the diameter $D_P$ of the package 3 is equal to and less than the maximum diameter $D_{HP}$, it is determined that it is possible to wind, and the diameter $D_P$ of the package 3 is compared at a step $P_{25}$ with the diameter $D_N$ calculated in the program JOB-1 shown in FIG. 3. When the diameter $D_P$ is equal to the diameter $D_N$, a winding ratio W corresponding to the diameter $D_P$ of the package 3 is looked up at a step $P_{26}$ and advances to a step $P_{27}$. When, on the other hand, the diameter $D_P$ is not equal to the diameter $D_N$, the step $P_{25}$ advances directly to the step $P_{27}$ without through the step $P_{26}$. At the step $P_{27}$, a standard value B of the number of traverses is calculated in accordance with the following equation (9):

$$B = N_B/W_N \quad (9).$$

The standard value B calculated at the step $P_{27}$ is compared at a step 28 with sampled values of the number of rotations $N_T$ of the yarn traversing cam 5, and the frequency of the invertor 11 supplying power to the motor 10 is controlled in accordance with the magnitude of the deviation between the standard value B and the number of rotations $N_T$ by a so-called PID control. Thereafter, the step 28 returns back to the step 22. Thus, the aforementioned steps are repeated until the diameter $D_P$ of the package 3 is more than the maximum diameter $D_{HP}$. In this instance, the yarn is traversed alternately in opposite directions along the length of the package 3 on the bobbin 2 so that the winding ratio is the winding ratio $W_N$ determined in the program JOB-1 during the yarn winding operation. As a result, the occurrence of the ribbonning is prevented, and therefore the yarn wound according to the present invention is enhanced in quality. The reason why the yarn is suitably traversed is that the winding ratio preventing the occurrence of the ribbonning is determined in advance in the program JOB-1 before the operation of the yarn take-up machine commences. The determination of such winding ratio will hereinafter be described in detail in conjunction with FIG. 6.

Figure 6:
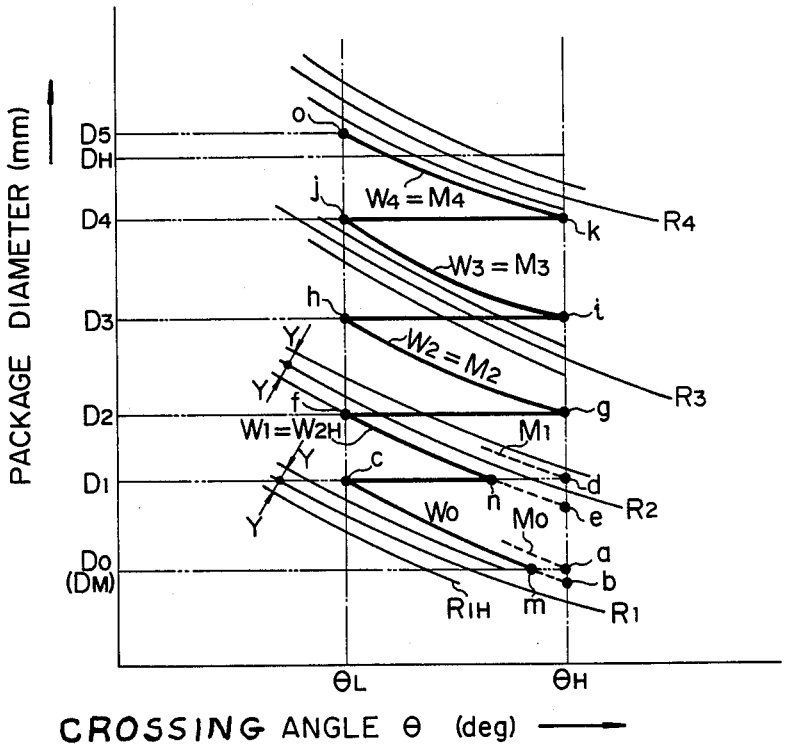
FIG. 6 shows the relationship between the winding ratio and a ribbon occurrence region with the crossing angle in degree taken on the abscissa and with a package diameter in mm taken on the ordinate.

As stated above, the yarn winding speed $V_1$, yarn traverse stroke S, yarn width w, upper limit value $\theta_H$ of the crossing angle, and ribbon occurrence region Y are first inputted at the step $P_1$ of the program JOB-1. The lower limit value $\theta_L$ of the crossing angle is then calculated in accordance with the upper limit value $\theta_H$ of the crossing angle inputted at the step $P_1$ and the aforementioned equation (1). The change count value N is set up as N=0, so that the diameter $D_N$ of the unwound bobbin 2 is set up as $D_0$ at the step $P_3$. It is noted that the diameter $D_0$ of the unwound bobbin 2 may be inputted in advance at the step $P_1$. At the step $P_4$, the number of turns $T_0$ of the yarn wound on the unwound bobbin 2 over one layer (that is, the number of turns $T_0$ of the yarn when a distance of two traverse strokes 2S is divided by the width w of the yarn) is calculated by the aforementioned equation (2) and changed into an integral number. Likewise, at the step $P_5$, the number of turns $T_{1(0)}$ of the yarn over one pitch (when the diameter $D_N$ is equal to $D_0$ and the upper limit value of the crossing angle is $\theta_H$) is calculated by the aforementioned equation (3) wherein the change count value N equals to zero, and changed into an integral number. Thereafter, according to the number of turns $T_0$ and the number of turns $T_{1(0)}$, the temporary winding ratio $M_0$ is calculated by the aforementioned equation (4) wherein the change count value N equals to zero. That is, a winding ratio of a point a indicated in FIG. 6 is obtained. The temporary winding ratio $M_0$ of the point a is compared with the ribbon occurrence region Y. In this embodiment, since the point a is outside the ribbon occurrence region Y, the $T_{1(0)}$ and the $T_0$ are discriminated whether they are prime numbers from each other or not. In this embodiment, since the $T_{1(0)}$ and the $T_0$ are not prime numbers from each other, a value of 1 is added to the $T_0$. When the $T_0$ and the $T_{1(0)}$ become prime numbers from each other and the temporary winding ration $M_0$ is not within the ribbon occurrence region Y, the true winding ratio $W_0$ is calculated in accordance with the aforementioned equation (6) wherein the change count value N equals to zero. The winding ratio $W_0$ thus obtained corresponds to a point b indicated in FIG. 6. Accordingly, a point m of FIG. 6 is a starting point of the winding ratio of the unwound bobbin. Thereafter, the yarn package diameter $D_1$ is calculated when the lower limit value of the crossing angle and the winding ratio are $\theta_L$ and $W_0$, respectively. That is, the diameter of a point c of FIG. 6 is obtained. The yarn package diameter $D_1$ is compared with the unwound bobbin diameter $D_0$ previously calculated. Since the diameter $D_1$ is more than the diameter $D_0$, the winding ratio $W_0$ corresponding to the diameter $D_0$ is memorized. As a result, the yarn is wound between the diameters $D_0$ and $D_1$ with the winding ratio $W_0$ indicated by line m-c which is not within the bobbin occurrence region Y. In this instance, since the diameter $D_0$ is less than the maximum diameter $D_H$ of the machine specification value, the program JOB-1 is repeated.

That is, the change count value N is increased as N+N=1 so that the number of turns $T_{1(1)}$ of the yarn over one pitch (when the diameter $D_N$ is equal to the yarn package diameter $D_1$ and the upper limit value of the crossing angle is $\theta_H$) is first calculated by the aforementioned equation (3), and the temporary winding ratio $M_1$ is calculated this time by the aforementioned equation (4). The winding ratio $M_1$ corresponds to a point d indicated in FIG. 6. Since the point d is within the ribbon occurrence region Y, the temporary winding ratio $M_1$ is replaced with an upper limit value $R_{2H}$ of the ribbon occurrence region Y ($M_1=R_{2H}$). A new $T_0$ is calculated when the temporary winding ratio is the upper limit value $R_{2H}$ of the ribbon occurrence region Y, and changed into an integral number. The temporary winding ratio $R_{2H}$ corresponds to a point e indicated in FIG. 6. At the step $P_8$, the $T_{1(1)}$ and the $T_0$ are discriminated whether they are prime numbers from each other or not. Since the $T_0$ and the $T_{1(1)}$ are prime numbers from each other, the true winding ratio $W_1$ is calculated. The diameter $D_2$ is calculated from the winding ratio $W_1$ when the lower limit value of the crossing angle is $\theta_L$ and the winding ratio is $W_1$. The diameter $D_2$ corresponds to a point f of FIG. 6. The diameter $D_2$ is compared with the diameter $D_1$ previously calculated. Since the diameter $D_2$ is more than the diameter $D_1$, the winding ratio $W_1$ corresponding to the diameter $D_1$ is memorized. The winding ratio $W_1$ starts from a point n of FIG. 6 when the diameter is $D_1$. The diameter $D_1$ is compared with the maximum diameter $D_H$ of the machine specification value. Since the diameter $D_1$ is still less than the maximum diameter $D_H$ of the machine specification value, the program JOB-1 is repeated.

Likewise, the change count value N is increased to 2, and the number of turns $T_{1(2)}$ is first calculated when the diameter of the package is $D_2$ and the upper limit value of the crossing angle is $\theta_H$, and the winding ratio $M_2$ is calculated this time. The winding ratio $M_2$ corresponds to a point g indicated in FIG. 6. The above noted processes are hereinafter repeated. As a result, as shown in FIG. 6, the winding ratio $M_2$ between the package diameters $D_2$ and $D_3$ is indicated by line g-h. The winding ratio $M_3$ between the package diameters $D_3$ and $D_4$ is indicated by line i-j. The winding ratio $M_4$ between the package diameters $D_4$ and $D_5$ is indicated by line k-o. The package diameter $D_5$ at the point o is compared with with the maximum diameter $D_H$ of the machine. In this embodiment, since the package diameter $D_5$ is more than the maximum diameter $D_H$, the program JOB-1 ends.

Thus, before the yarn traversing device is operated, the winding ratio which is capable of suitably avoiding the occurrence of the ribbonning is properly set up in advance in accordance with the various datum of yarn. Accordingly, the occurrence of the ribbonning can be effectively prevented when the yarn is traversed in opposite directions in accordance with the program JOB-2.

Figure 7:
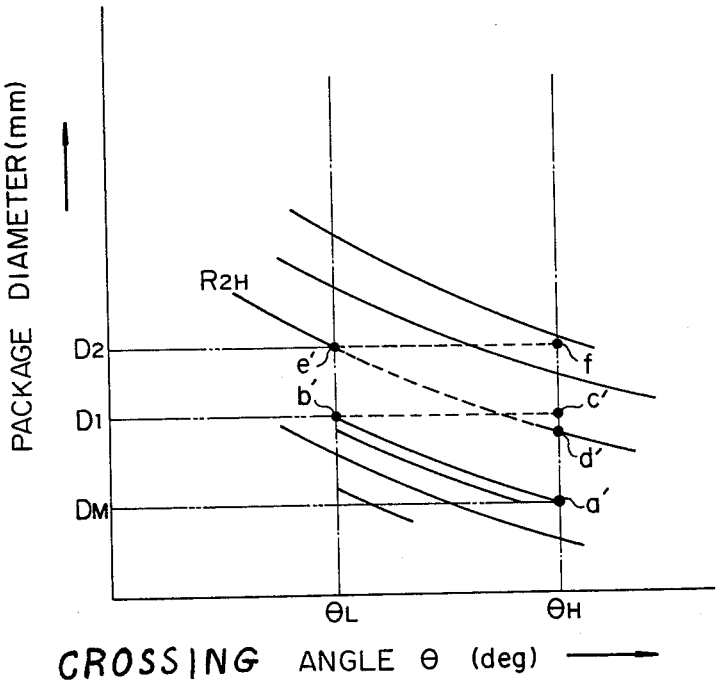
FIG. 7 shows the relationship between the winding ratio and the ribbon occurrence region in the case that the width between the upper and lower limit values of the crossing angle is relatively small.

FIG. 7 shows a characteristic of winding ratio when the difference between the upper and lower limit values $\theta_H$ and $\theta_L$ of the crossing angle is small. In FIG. 7, the winding ratio between points a' and b' is calculated as in the case of FIG. 6. At the point b', the winding ratio $M_N$ of a point c' is calculated. In this instance, since the winding ratio $M_N$ of the point c' is within the ribbon occurrence region Y, it is set up as $R_{2H}$ and the package diameter $D_N$ of a point e' is calculated. With $M_N=R_{2H}$, the package diameter $D_N$ is calculated again and as a result becomes equal to the diameter previously calculated. In this instance, the lower limit values $\theta_L$ of the crossing angle is set up as $\theta_L=\theta_L-0.1$, the aforementioned processes are repeated until the point f is moved outside the ribbon occurrence region Y, so that the width between the upper and lower limit values $\theta_H$ and $\theta_L$ of the crossing angle become minimum.

Although, in this embodiment, it has been determined at the step $P_{15}$ of the program JOB-1 whether the width between the upper and lower limit values $\theta_H$ and $\theta_L$ of the crossing angle is changed or not in accordance with the package diameter $D_N$, it is noted that the change of the width may be also determined in accordance with the winding ratio $W_N$ at the step preceding to the step $P_{13}$. Furthermore, although the upper limit value $\theta_H$ has been varied to change the width between the upper and lower limit values $\theta_H$ and $\theta_L$ of the crossing angle by the equation $\theta_L=\theta_H-0.1$, it is noted that the lower limit value $\theta_L$ may be varied by an equation $\theta_H=\theta_L-0.1$. Furthermore, while the $T_0$ has been processed when the $T_0$ and $T_{1(N)}$ are prime numbers from each other, it is noted that the $T_{1(N)}$ may be processed.

The effect of the present invention will hereinafter be compared with the aforementioned disadvantages (I), (II) and (III) attendant with the prior art.

With respect to (I): A desired winding ratio is suitably selected depending upon the yarn width and the like. Accordingly, in the case that a various kinds of yarns of different deniers are produced with a short cycle, the winding ratio can be easily varied depending upon different widths of different yarns. As a result, in the present invention, a loss resulting from the change of a yarn and a cost of production are extremely reduced.

With respect to (II): In the case that, in one yarn take-up device, it is required to vary a yarn traversing stroke depending upon a various kinds of yarns in response to the requirement of FMS (Flexible Manufacturing System which is a manufacturing system having functions capable of accommodation to multikind and small quantity production), the yarn traversing stroke can be easily varied in accordance with present invention for the same reason noted above.

With respect to (III):

Since the number of rotations of the bobbin is detected without mechanically connecting the bobbin with the yarn traversing device and in accordance with this detected value the number of traverse strokes is calculated, the yarn traverse apparatus according to the present invention does not have the disadvantages that there are fluctuations of winding ratio due to the contact pressure applied between the package and the friction roller and due to the rib portions at the axial opposite ends of the package, and thus the yarn is enhanced in quality.

In addition to the aforementioned effects, since the difference between the upper and lower limit values of the crossing angle is gradually increased by extremely small quantities (0.1 degrees), an unevenness on the lateral end faces of the package can be minimized which is caused by variation of strokes and the like resulting from variation of the crossing angle during the winding operation, thereby enhancing quality of the yarn and configuration of the package.

While, in the aforementioned embodiment of the present invention, the width between the upper and lower limit values $\theta_H$ and $\theta_L$ of the crossing angle has been maintained constant from the beginning to the end of the winding operation, it is noted that the width of the crossing angle may also be controlled to be selected between 0.1 and 0.2 degrees if the winding ratio is not within the ribbon occurrence region and minimized only when the winding ratio is within the ribbon occurrence region.

Such a variation of the width of the crossing angle will hereinafter be described as a second embodiment of the present invention in conjunction with FIGS. 8 and 9.

Figure 8:
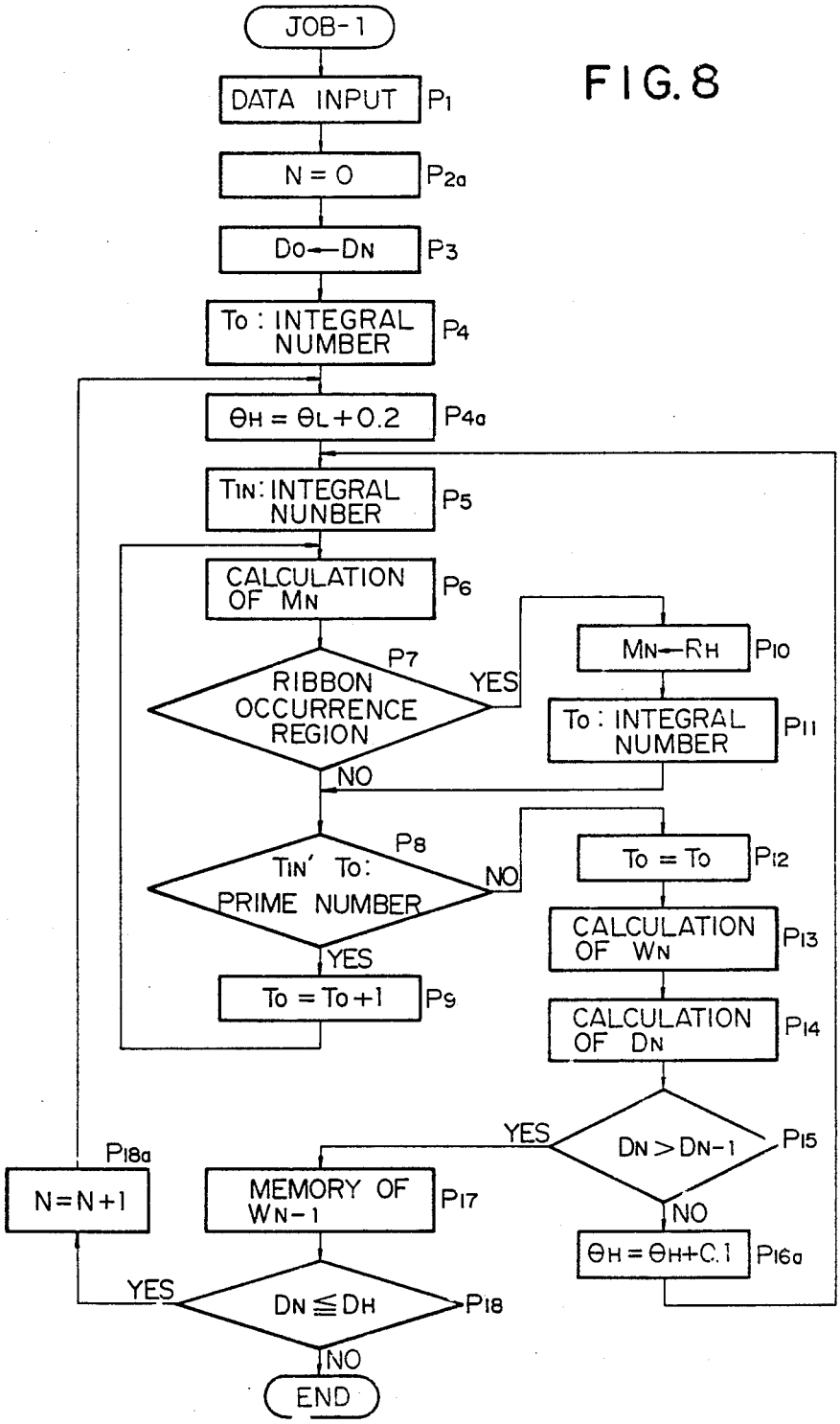
FIG. 8 is a block diagram of a program for calculating the winding ratio of another embodiment of the yarn traverse apparatus according to the present invention.

In a program shown in FIG. 8, the step $P_2$ of the program shown in FIG. 3 is omitted and a new step $P_{4a}$ is added therefor. At the step $P_{4a}$, the upper limit value $\theta_H$ of the crossing angle is calculated in accordance with the following equation (10), and at a step $P_{16a}$, the upper limit value $\theta_H$ of the crossing angle is calculated in accordance with the following equation (11):

$$\theta_H=\theta_L+0.2 \quad (10),$$

$$\theta_H=\theta_L+0.1 \quad (11).$$

Figure 9:
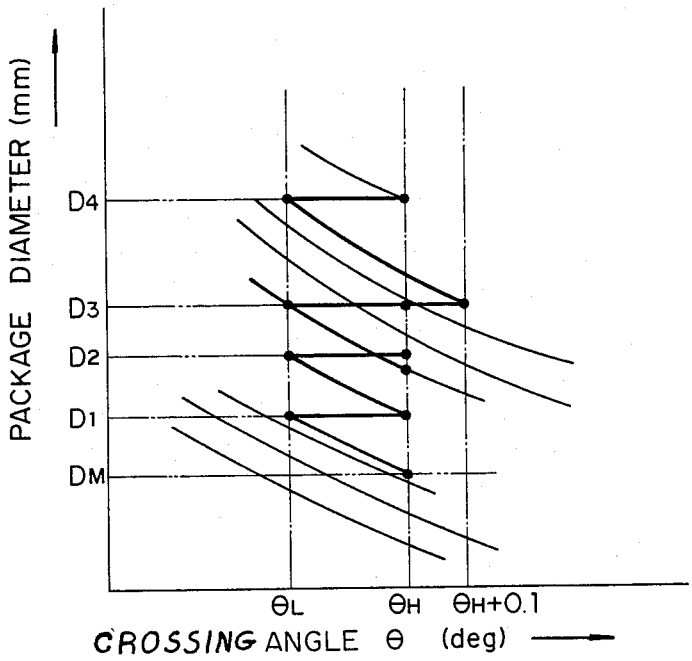
FIG. 9 shows the relationship between the winding ratio and the ribbon occurrence region according to the embodiment shown in FIG. 8.

As a result, in the case that the winding ratio is within the ribbon occurrence region as shown in FIG. 9, the ratio of the and lower limit values $\theta_H$ and $\theta_L$ is raised to a unit with $M_N$ and $R_H$ for the first time, and the upper limit value $\theta_H$ increases by 0.1 degrees because $D_N$ is equal to or less than $D_{N-1}$ after the second time. Thereafter, the width between the upper and lower limit values $\theta_H$ and $\theta_L$ is varied and reduced to the minimum value so that the winding ratio is moved outside the ribbon occurrence region.

It is noted that, in the case of the second embodiment, at a step $P_l$, the value of $\theta_L$ is inputted in stead of the value of $\theta_H$. Also, in the calculation at the step $P_4$, the value of 0.2 in the equation (10) may be inputted as an input data at the step $P_1$. Furthermore, in the second embodimentnt, although the upper limit value $\theta_H$ has been varied to change the width between the upper and lower limit values $\theta_H$ and $\theta_L$ of the crossing angle by the equations $\theta_H=\theta_L+0.2$ and $\theta_H=\theta_L+0.1$, it is noted that the lower limit value $\theta_L$ may be also varied by equations $\theta_L=\theta_H+0.2$ and $\theta_L=\theta_H+0.1$. Furthermore, while the yarn winding speed has been detected in the calculation of the package diameter $D_N$, it is noted that values set by the setting device may be also used. The present invention is applicable to both yarn take-up devices of the spindle drive type and the friction drive type. While, in the first and second embodiments, the induction motor has been used, it is noted that a synchronous motor, a DC motor and the like may be also used.

From the foregoing description, it will be seen that an improved yarn traverse apparatus which is capable of enhancing quality of the yarn wound on the bobbin and which eliminates the aforementioned disadvantages attendant with the prior art is afforded by the present design.

While certain representative embodiments and details have been shown for the purpose of illustrating the invention, it will be apparent to those skilled in this art that various changes and modifications may be made therein without departing from the spirit or scope of the invention.

What I claim is:

1. A yarn traverse apparatus comprising a bobbin on which a yarn is wound forming a yarn package;

means for rotating said bobbin;

setting means for setting upper and lower limit values of a crossing angle of said yarn, a traverse stroke of said yarn wound on said bobbin, a width of said yarn wound on said bobbin, and a ribbon occurrence region;

bobbin rotational number detecting means for detecting the number of rotations of said bobbin on which said package is wound;

winding-speed detecting means for detecting a winding speed of said yarn;

package-diameter operation means for calculating a diameter of said package in accordance with said number of rotations of said bobbin detected by said bobbin rotational number detecting means and said winding speed of said yarn detected by said winding-speed detecting means;

winding-ratio operation means for calculating a winding ratio in accordance with the number of turns of said yarn when a distance of two traverse strokes is divided by said yarn width and the number of turns of said yarn when one pitch corresponding to said upper limit value of said crossing angle is divided by said yarn width;

traverse operation means for calculating the number of traverse strokes in accordance with said number of rotations of said bobbin and said winding ratio corresponding to said package diameter; and a traverse mechanism for traversing said yarn alternately in opposite directions parallel to an axis of rotation of said bobbin in accordance with an output of said traverse operation means so that said yarn is wound throughout said traverse stroke of said package;

said winding-ratio operation means varying said winding ratio in steps so that said winding ratio is moved outside said ribbon occurrence region when said package diameter reaches a predetermined value between said upper and lower limit values of said crossing angle.

2. A yarn traverse apparatus as set forth in claim 1, in which said winding-ratio operation has means for raising fractions of a winding ratio to a unit if the winding ratio is within said ribbon occurrence region.

3. A yarn traverse apparatus as set forth in claim 1, in which said setting means has means for changing said upper and lower limit values of said crossing angle, and in which said winding-ratio operation means has means which, if the winding ratio is within said ribbon occurrence region, raises fractions of the winding ratio to a unit for the first time and varies the winding ratio in steps within a region of said upper and lower changed limit values of said crossing angle after the second time.

* * * * *